US008931134B2

(12) United States Patent
Jefferson et al.

(10) Patent No.: US 8,931,134 B2
(45) Date of Patent: Jan. 13, 2015

(54) ROTATING BATHROOM FLOOR MAT DEVICE

(76) Inventors: Curtis Jefferson, Cantonment, FL (US); Kimberly Jefferson, Cantonment, FL (US)

( * ) Notice: Subject to any disclaimer, the term of this patent is extended or adjusted under 35 U.S.C. 154(b) by 803 days.

(21) Appl. No.: 13/149,413

(22) Filed: May 31, 2011

(65) Prior Publication Data

US 2011/0296704 A1 Dec. 8, 2011

Related U.S. Application Data

(60) Provisional application No. 61/351,316, filed on Jun. 4, 2010.

(51) Int. Cl.

| | |
|---|---|
| ***A47L 23/00*** | (2006.01) |
| ***A47K 7/00*** | (2006.01) |
| ***F26B 5/16*** | (2006.01) |
| ***F26B 25/10*** | (2006.01) |

(52) U.S. Cl.
CPC .. *F26B 5/16* (2013.01); *F26B 25/10* (2013.01)
USPC ..... 15/310; 15/36; 15/97.2; 15/161; 15/215; 15/217; 34/90

(58) Field of Classification Search
USPC ..... 15/310, 311, 30–37, 97.2, 161, 15/215–217, 104.92; 4/535, 661; 34/90, 34/218
See application file for complete search history.

(56) References Cited

U.S. PATENT DOCUMENTS

| | | | | |
|---|---|---|---|---|
| 2,953,805 | A * | 9/1960 | Sevenich | 15/310 |
| 3,482,272 | A * | 12/1969 | McLennon | 15/36 |
| 3,526,015 | A * | 9/1970 | Nappi | 15/36 |
| 3,940,820 | A * | 3/1976 | Smolka | 15/36 |
| 4,014,060 | A * | 3/1977 | Taylor | 15/36 |
| 4,313,238 | A * | 2/1982 | Harbin | 15/37 |
| 4,782,601 | A | 11/1988 | Gonzalez | |
| 5,438,764 | A | 8/1995 | Reppas | |
| 5,454,060 | A | 9/1995 | McDermott | |
| 6,189,231 | B1 | 2/2001 | Lancer | |

(Continued)

FOREIGN PATENT DOCUMENTS

| | | | |
|---|---|---|---|
| DE | 10013835 | * | 9/2001 |
| DE | 10129435 | * | 3/2002 |

(Continued)

*Primary Examiner* — Mark Spisich

(74) *Attorney, Agent, or Firm* — Daniel Boudwin; Global Intellectual Property Agency LLC

(57) ABSTRACT

A rotating bathroom floor mat device is disclosed, comprising a series of carpeted, rotatable assemblies, a heating means and a gear and pulley mechanism. The device provides a wide, rectangular enclosure that allows a user to step directly onto its flat, upper surface, which is comprised of a series of adjoining, rotatable surfaces. Control buttons along one side of the upper service are operable via depression of a user's foot, which in turn activates a heating means and fan convection means to rapidly dry a user's feet and remove moisture from the carpeted assemblies. The assemblies are triangular sections that allow three distinct working surfaces. Once a first user has dried his or her feet, the assemblies are rotated to reveal a fresh, dry surface for a second user. The heating and convection means dries the previously used, moist carpet while in a stowed position. Three surfaces allow three consecutive users to enjoy a dry surface when exiting a shower, and to enjoy the heating means that dries both the carpet and the user's feet.

11 Claims, 3 Drawing Sheets

(56) References Cited

U.S. PATENT DOCUMENTS

| | | | | |
|---|---|---|---|---|
| 7,051,393 | B2 * | 5/2006 | Cox | 15/30 |
| 7,278,225 | B1 | 10/2007 | Espinosa | |
| 2004/0049842 | A1 | 3/2004 | Prehodka | |

FOREIGN PATENT DOCUMENTS

| | | |
|---|---|---|
| JP | 3-244416 | * 10/1991 |
| JP | 3-268733 | * 11/1991 |
| JP | 6-90891 | * 4/1994 |

* cited by examiner

ROTATING BATHROOM FLOOR MAT DEVICE

CROSS REFERENCE TO RELATED APPLICATION

This application claims the benefit of U.S. Provisional Application No. 61/351,316 filed on Jun. 4$^{th}$, 2010, entitled "Rotating Bathroom Floor Mats"

BACKGROUND OF THE INVENTION

1. Field of the Invention

The present invention relates to bathroom floor mats and mechanisms for drying thereof. More specifically, the present invention pertains to a new and unique device that provides a series of rotatable floor mat assemblies for consecutive users to enjoy a fresh, dry surface when exiting a shower.

2. Description of the Prior Art

A common residential bathroom article is a floor mat that provides a user with a carpeted or moisture absorbing surface to step upon when exiting a shower. These mats are generally sections of carpeting with a non-slip backing surface, with the carpeting fabric directed to absorb moisture and dry a user's feet. In use, these items are stepped upon as a user exits a shower, depositing moisture into the carpet in the process. Commonly, these mats are left to operate for extended periods of time. Accumulation of moisture, combined with a humid bathroom environment, can lead to mold and mildew development within the carpeting of the mat. Repeated uses of the same floor mat can also lead to a saturated mat that does not adequately dry a user's feet or absorb all water from their feet. This leaves the user with wet, potentially dirty feet and a bathroom floor surface subject to puddles of excess water from a saturated mat and the user walking about with undried feet.

Solutions to this problem have been highly absorbent or very thick floor mats, which provide increased capacity for moisture absorption and for repeated uses. However, this solution does not address the problem of adequate drying of the mat itself, which retains the moisture until drying naturally through the process of evaporation. Mold, fungus and mildew quickly develop in damp, dimly lit areas. Thick mats with deep recesses or long strands of shag can provide such an environment for these organisms to thrive. This requires a user to continually wash or replace a floor mat over time, which is cumbersome and time consuming. The mat will otherwise become unpleasantly odorous and potentially harmful for individuals, particularly those with allergies to mold and mildew.

The present invention provides a new and unique device that solves the problems associated with wet floor mats and for those which frequently endure repeated exposure. Specifically, the present invention is a device that provides rotatable carpeted assemblies that form a flat surface when in a working position. The rotatable assemblies are three-sided structures that are rotatable about their central axis. When aligned, they provide a flat surface. When rotated, a second and third carpeted surface is revealed to allow a fresh, dry mat for consecutive users. The assemblies are rotated by a belt and pulley system, driven by an electric motor and a gearing mechanism. A heating and air flow means are also provided, in the form of an electric heater device and a plurality of fans. These devices serve to dry the carpeted assemblies when in a stow position, and to further dry a user's feet when placed on the device's upper surface. Power is derived from onboard battery power, or alternatively from a power cord and transformer assembly.

Floor mat devices have been described in the art with improved means for drying a user's feet, however most contemplate a drying device and means of convection only. These devices are described for both comfort and for therapeutic reasons, most notably for preventing the spread of athlete's foot (mycosis) and planter's warts. These devices describe suction, blower and other convection means for rapid evaporation of moisture from a practitioner's feet. None describe a rotating floor mat assembly that provides several fresh, carpeted surfaces for continual use. The present invention provides such a device, including a heater drying means and convection means, and one that requires no external convection means, such as a vacuum or blower.

U.S. Pat. No. 5,438,764 to Reppas is one such device, wherein a foot and toe drying device is described for combating athlete's foot. The device comprises a series of apertures through which air is directed to forcibly air-dry an individual's toes. A heating device and a powder dispensing system are also included in furtherance of removing moisture from the toe region of the foot. This device is specifically for air-drying a foot and preventing athlete's foot. An individual would use such a device only after hand drying his or her feet, as opposed to the present invention, which provides a surface to step upon immediately after a shower without the need to pre-dry.

U.S. Pat. No. 4,782,601 to Gonzalez describes another foot drying device in which air is forced over a user's feet from below and across the foot from an adjacent platform. A blower assembly directs the air through the platform and up through the floor of the device, while push-button control is provided for the user to control the function of the device and options therefor. A heater means is also provided for increasing moisture evaporation. This device offers adequate drying means, in the form of an air flow and heating means; however this device falls short of describing the present invention or providing a dry surface for consecutive users to stand upon.

U.S. Pat. No. 7,278,225 to Espinosa describes a single foot-drying device that includes a sloping surface for positioning of a user's foot, and apertures thereon for discharging heated air. A mechanism is provided for diverting water droplets originated from the user's foot outwardly from the chamber and through the apertures. While this device removes excess moisture and droplets of water, no mechanism for providing a clean, dry surface is provided for the user to place his or her feet.

U.S. Pat. No. 6,189,231 to Lancer is another foot drying device having a footrest and a blower assembly for drying a user's foot and dispensing a moisture of fungus inhibiting agent downwardly onto the food. While this device is useful for treating conditions such as athlete's foot, foot fungus and planter's warts, there is no mention of a means for drying the surface for which the user places his or her feet. No device for providing a fresh surface to stand upon for consecutive users is described as well.

U.S. Pat. No. 5,454,060 to McDermott describes a foot drying apparatus with a grated, open top surface and a pressure sensitive switch to automatically initiate a thirty second timed flow of heated air over a user's foot for drying and for therapeutic purposes. An internal fan and heating element is provided to generate the heat and air flow qualities of the device, while the pressure switch and timing mechanism provide automatic starting and prevention of overheating. While this device may be useful for drying a user's feet, the grated top surface does not provide the degree of comfort afforded by a traditional carpeted floor mat. The surface of the McDermott patent would likely cause discomfort and pressure points as the user steps onto the device. The present invention provides all of the benefits of a traditional bathroom floor mat, including a carpeted or otherwise padded surface, along with the additional benefits of heated and air drying means, along with a structure that provides a fresh surface for multiple, consecutive users.

The devices in the prior art fulfill their respective objectives and requirements, but they fail to fully describe the features and aspects present invention's structure and intent. In particular, the use of rotatable assemblies to provide a continuous feed of dry surface for a practitioner to utilize when exiting a shower and drying his or her feet. The assemblies are powered by an internal belt and pulley system, which is provided motive force via an electric motor and motor controller. User input is provided in the form of push buttons for the user to depress with their feet. These controls include toggling the use of the heater, the fan blower means and rotation of the assemblies if no pressure is indicated in the pulley system, and thereby ensuring a user is not standing on the assemblies while trying to rotate them. The present invention substantially diverges in design elements from the prior art and consequently it is clear that there is a need in the art for an improvement to existing floor mat devices. In this regard the instant invention substantially fulfills these needs.

SUMMARY OF THE INVENTION

In view of the foregoing disadvantages inherent in the known types of bathroom floor mat and foot drying devices now present in the prior art, the present invention provides a new bathroom floor mat device wherein the same can be utilized for providing convenience for the user when requiring a fresh, dry surface to step on when leaving the shower, particularly after continued and persistent user by a plurality of users.

It is therefore an object of the present invention to provide a bathroom floor mat device that provides a plurality of rotatable assemblies of triangular cross section. The assemblies employ an outer surface comprising of floor mat or carpeting material for the user to step onto after a shower. While in their working positions, the assemblies align along the upper plane of the device to provide a uniform surface upon which to stand. The two remaining surfaces of the triangular assemblies are in a stowed position, and may therefore be attended to by a heater means and forced air blower means to dry their structure between uses.

Another object of the present invention is to provide a bathroom floor mat structure of largely rectangular construction, with an imbedded drive means for rotating for rotating the triangular mat assemblies.

Another object of the present invention is to provide a heater and forced air blower means to fulfill two roles: primarily to dry the rotatable assemblies when in a stowed position, and secondarily to provide heat and convective air flow to the user's feet through and around the rotatable assemblies.

Another object of the present invention is to provide a rotating bathroom floor mat structure with an embodiment of the drive means comprising an electric motor, a motor controller and a belt and pulley system.

Another object of the present invention is to provide removable floor matting material from the surfaces of the rotatable assemblies, allowing cleaning and replacement thereof, or alternative arrangements for user preference.

Yet another object of the present invention is to provide a bathroom floor mat structure that provides user control over the operation of the device, including the heater means, the air blower means and the rotation of the rotatable assemblies.

It is therefore an object of the present invention to provide a new and improved bathroom floor mat device that has all of the advantages of the prior art and none of the disadvantages.

Other objects, features and advantages of the present invention will become apparent from the following detailed description taken in conjunction with the accompanying drawings.

BRIEF DESCRIPTIONS OF THE DRAWINGS

DETAILED DESCRIPTION OF THE INVENTION

Figure 1:
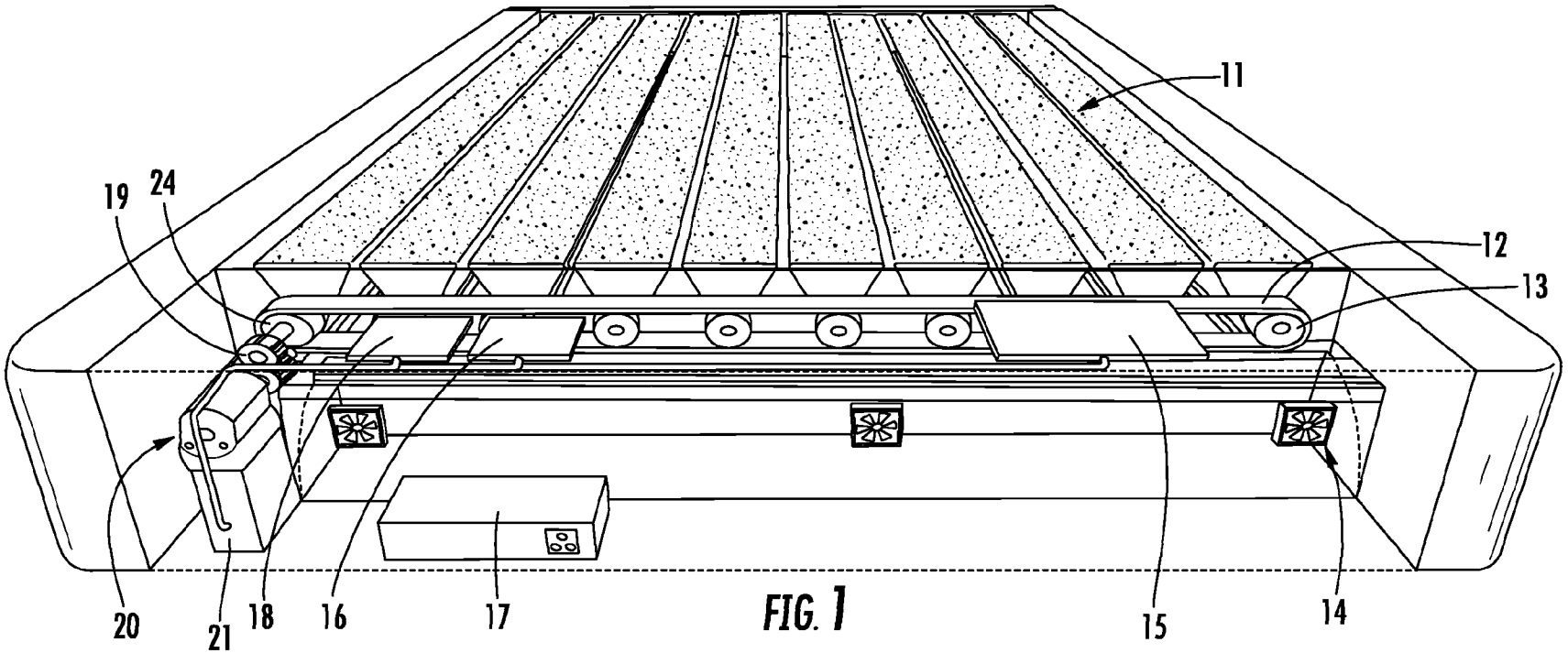
FIG. 1 shows a side perspective view of the present invention, including a view of the internal structure of the belt and pulley mechanism that provides motion to the rotatable assemblies.

Referring now to FIG. 1, there is shown a side perspective view of the present invention and an embodiment of the drive means thereof. A plurality of rotatable assemblies 11 are aligned along the upper surface of a largely rectangular enclosure. Along the central axis of each assembly 11 is a rod that connects to a rotatable pulley 13. The pulleys 13 align along a straight line and are connected via a belt 12 that mateably connects to each pulley 13 radial surface to provide rotational control and motive means. A drive pulley 24 is attached to a gearing mechanism 19 at one end of the device. The gearing mechanism 19 ties to the drive pulley 24 at its first end, and connects to an electric motor 20 at its second end. The electric motor provides the motive force to drive the gears 19 and the drive pulley 24, and ultimately control the orientation and rotation of the rotatable assemblies 11. A motor controller 21 is provided to provide input to the electric motor, corresponding to input from the user in the form of a push buttons 15 that the user can depress with his or her feet. Electric motor 20, motor controller 21, gearing mechanism 19, drive pulley 24 and belt 12 represent a drive means for the rotatable assemblies 11.

Alternate drive means are contemplated for the operation of the present invention, including a belt and pulley system, a series of gearing mechanisms, electric actuation of each rotatable assembly, or any other obvious variation of electromechanical actuation that would perform the duty of rotating the plurality of rotatable assemblies based on user input. It is not desired to limit the present invention to the drive means illustrated in the associated figures, but rather this configuration is a particularly suited embodiment that accomplishes the desired task of rotating a floor mat assembly for consecutive users and providing a stable platform of fresh mat material therefor.

The rotatable assemblies 11 are triangular structures with three distinct surfaces. One surface is provided for the user to stand upon at a given time, which is designated as a surface in a working position. This position places that surface facing outward from the enclosure and in a position for a user to place his or her feet while exiting a shower. The remaining two surfaces face inward, and are sheltered by the enclosure. These surfaces are considered to be in their stowed position. In the stowed position, the surfaces may be subjected to a heating means and a forced air means for the purposes of drying and preparing their future use if the assemblies are further rotated. The additional rotation places a previously stowed surface in a working position. Each of the surfaces on the assemblies 11 are covered with carpeting or other common bathroom floor mat material that is absorbent, resilient and resistant to mold and mildew.

The bathroom floor mat material covering the surfaces of the rotatable assemblies 11 is preferably removable for cleaning and replacement purposes. Different users may also prefer different floor mat materials, which allows personalization and accessorization of the present invention to meet user tastes and preferences. The matting may be attached in any number of methods suitable for fastening their backing surface to the surface of the rotatable assemblies 11, including hook and loop fastening, buttons or snaps. Alternatively, an embodiment of the present invention may permanently affix the matting material to the rotatable assemblies.

A plurality of fans 14 direct outside air into the enclosure at a given flow rate. The fans 14 drive air through the device and over the rotatable assemblies 11, particularly over the stowed surfaces of the assemblies 11 for drying and preparation purposes. Air also bleeds through the gaps between the rotatable assemblies 11 to provide a soothing, convective air flow over the user's feet to facilitate further evaporation and comfort. An electric heating means is provided within the enclosure and beneath the rotatable assemblies 11, and may comprise of an electric coil heating device. The electric heating means provides warm air to improve drying of each stowed surface and to further dry the user's feet as he or she stands on the device. An onboard battery power supply 17 is provided for powering the heating and fan blowing means 14, along with the electric motor 20 that powers the rotatable assemblies 11. The battery pack 17 may be rechargeable. In an alternate embodiment, the battery pack may be replaced by a transformer and a socket for accepting AC wall power.

Control for the fans 14, heating means and rotation of the assemblies 11 is provided for the user in the form of push buttons placed on the upper surface of the enclosure. The user may desire a fresh, dry carpeted surface, along with heat and air movement. Alternatively, the user may desire a combination thereof. Control of each is provided by three distinct push buttons. A rotation button 15, a heater button 18 and a fan button 16.

Figure 2:
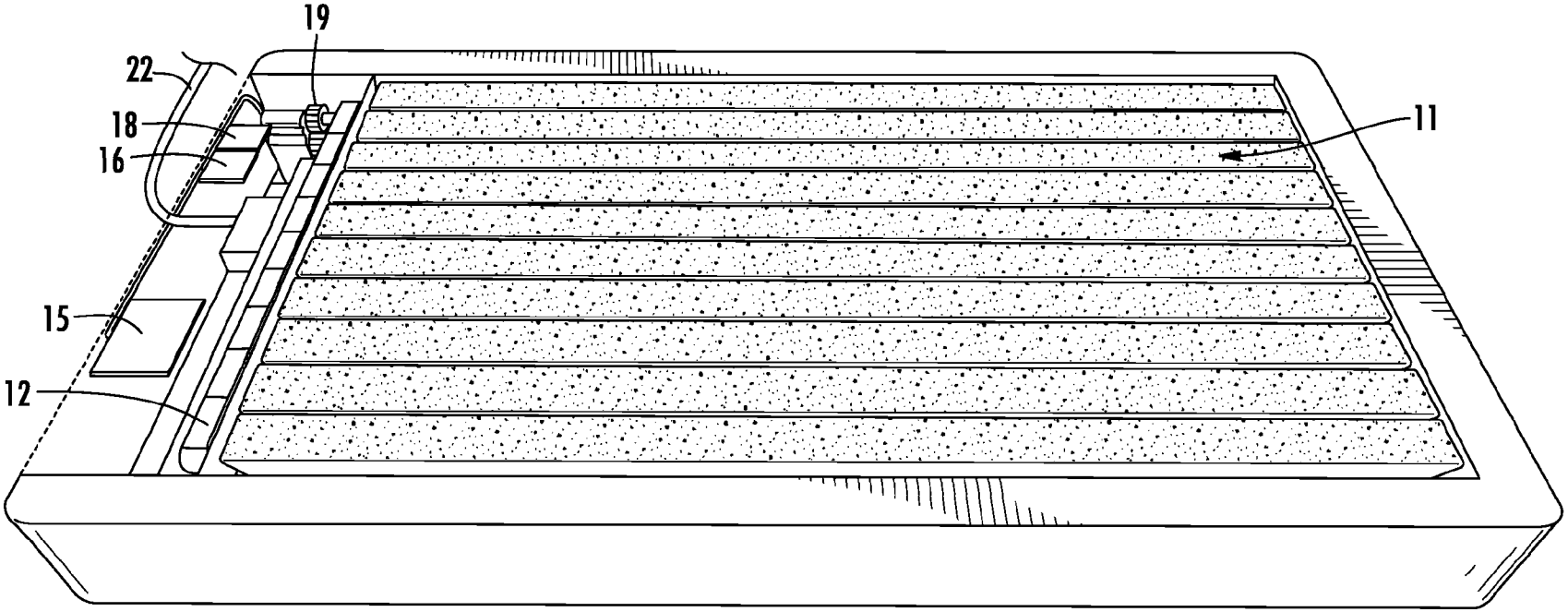
FIG. 2 shows an overhead perspective view of the present invention, wherein the rotatable assemblies are aligned and provide a flat surface for a user to stand upon after exiting a shower.

Referring now to FIG. 2, there is shown an overhead perspective view of the present invention. As shown, the working surfaces of the rotatable assemblies 11 are aligned in preparation for a user to place his or her feet after exiting a shower. The push button controls 15, 16, and 18 are provided along the periphery of the upper surface of the enclosure. The pulley 12 and gearing mechanism 19 are also visible. These items are hidden from the view of the user by an opaque surface that extends from the edges of the rotatable assemblies 11 to the end of the enclosure. The push buttons may be slightly lifted above this surface to afford texture for a user to depress with his or her feet. An optional power cord 22 is also provided for an embodiment of the present invention wherein wall power is necessary or onboard batteries are being recharged.

Figure 3:
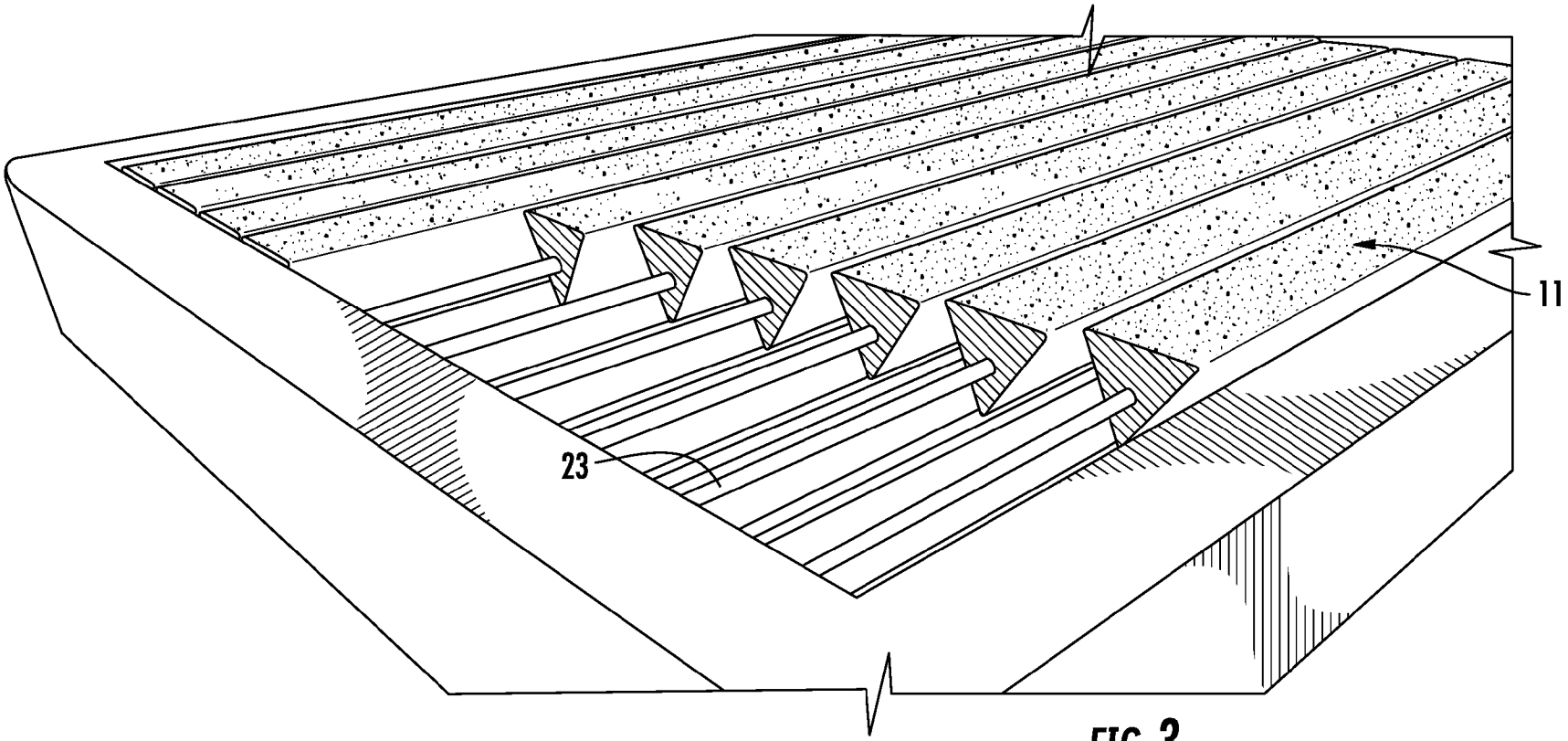
FIG. 3 shows an alternate side perspective view with a cut-away of the rotatable assemblies to highlight their structure and cross-section.

Referring now to FIG. 3, there is shown another side perspective view of the present invention and a cut-away of the rotatable assemblies 11. As shown, the rotatable assemblies 11 are of triangular cross-section with three carpeted exterior surfaces. A bar 23 runs through the central axis of each assembly to provide a means to connect the assemblies 11 to their associated pulley. The rods connect at a first end to a pulley, while their second end mates to a ball bearing device that allows low friction rotation about the rod's 23 neutral axis.

In use, an individual positions the rotatable floor mat assembly on the floor and in front of a shower. When exiting a shower, a user steps onto the carpeted or otherwise covered rotatable assemblies to dry off and to utilize the assemblies to absorb moisture from his or her feet. The heating means and forced air means may be utilized by depressing the appropriate push buttons on the top surface of the device. After drying off, the user may step off of the device and press the rotation butt to rotate the assemblies. A fresh, dry surface is revealed for a subsequent user. While in use, the assemblies are held in their position by the belt and pulley system, eliminating any rotation caused by the user stepping in between assemblies. In this manner, the upper surface is kept flat for the user and prevents a user's foot from falling between assemblies. In total, the device provides a means to accommodate several consecutive users and to provide each with a dry floor mat surface to utilize. Further drying and comfort is provided by the heating and forced air means.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A rotatable floor mat device, comprising:

an enclosure with a plurality of rotatable assemblies having a triangular cross section;

said assemblies having outer surfaces covered by a matting material;

said assemblies align in a working position to provide a flat surface for a user to stand upon, a drive means for rotating said assemblies, a heating means for evaporating moisture in said rotatable assemblies;

a forced air means for moving air across said rotatable assemblies.

2. A device as in claim 1, wherein said matting material is removable from said assembly outer surfaces for cleaning and replacement purposes.

3. A device as in claim 1, wherein said matting material is absorbent carpet.

4. A device as in claim 1, wherein said drive means comprises an electric motor and motor controller, a gearing mechanism, a drive pulley, and a belt that connects said drive pulley to individual pulleys attached to each rotatable assembly.

5. A device as in claim 1, wherein said heating means comprises an electric coil heater below said rotating assemblies.

6. A device as in claim 1, wherein said forced air means comprises a plurality of fans that force air across said rotatable assemblies.

7. A device as in claim 1, wherein push button controls are provided for operating said heating means, said forced air means and said assembly rotation.

8. A device as in claim 1, wherein electric power is provided via internal batteries.

9. A device as in claim 1, wherein electric power is provided via external AC power.

10. A rotatable floor mat device, comprising:

an enclosure with a plurality of rotatable assemblies of triangular cross section;

said assemblies having outer surfaces covered by a matting material;

said assemblies align in a working position to provide a flat surface for a user to stand upon;

a drive means for rotating said assemblies comprising an electric motor and motor controller, a gearing mechanism, a drive pulley, and a belt that connects said drive pulley to individual pulleys attached to each rotatable assembly;

an electric coil heating means for evaporating moisture in said rotatable assemblies;

a plurality of fans for moving air across said rotatable assemblies.

11. A rotatable floor mat device, comprising:

an enclosure with a plurality of rotatable assemblies having a triangular cross section;

said assemblies align in a working position to provide a flat surface for a user to stand upon, an electric motor and motor controller for rotating said rotatable assemblies, said electric motor connected to a drive pulley and a belt, said belt connecting said drive pulley to individual pulleys attached to each of said rotatable assemblies;

an electric coil heating element for evaporating moisture in said rotatable assemblies;

one or more fans for moving air across said rotatable assemblies.

* * * * *